US008257818B2

(12) United States Patent
Ellis et al.

(10) Patent No.: US 8,257,818 B2
(45) Date of Patent: Sep. 4, 2012

(54) APERTURED DUSTING WIPE

(75) Inventors: Dianne Ellis, Cary, NC (US); Wanda B. Best, Dunn, NC (US)

(73) Assignee: Polymer Group, Inc., Charlotte, NC (US)

( * ) Notice: Subject to any disclaimer, the term of this patent is extended or adjusted under 35 U.S.C. 154(b) by 1127 days.

(21) Appl. No.: 11/530,493

(22) Filed: Sep. 11, 2006

(65) Prior Publication Data

US 2007/0060003 A1 Mar. 15, 2007

Related U.S. Application Data

(60) Provisional application No. 60/717,332, filed on Sep. 15, 2005.

(51) Int. Cl.

| | |
|---|---|
| ***B32B 3/10*** | (2006.01) |
| ***A47L 25/08*** | (2006.01) |
| ***A47K 10/02*** | (2006.01) |
| ***D04H 1/00*** | (2006.01) |
| ***C09K 3/22*** | (2006.01) |

(52) U.S. Cl. ... 428/131; 428/134; 428/136; 15/104.002; 15/209.1; 15/228; 252/88.2

(58) Field of Classification Search ..... None
See application file for complete search history.

(56) References Cited

U.S. PATENT DOCUMENTS

| | | | | |
|---|---|---|---|---|
| 2,862,251 | A | 12/1958 | Kalwaites | |
| 3,033,721 | A | 5/1962 | Kalwaites | |
| 3,081,514 | A | 3/1963 | Griswold | |
| 3,081,515 | A | 3/1963 | Griswold et al. | |
| 3,448,478 | A * | 6/1969 | Nash et al. | 15/104.93 |
| 3,747,161 | A * | 7/1973 | Kalwaites | 28/105 |
| 5,223,319 | A | 6/1993 | Cotton et al. | |
| 5,858,504 | A * | 1/1999 | Fitting | 428/131 |
| 5,914,177 | A | 6/1999 | Smith, III et al. | |
| 6,280,757 | B1 | 8/2001 | McAtee et al. | |
| 6,495,151 | B2 | 12/2002 | McAtee et al. | |
| 6,550,092 | B1 | 4/2003 | Brown et al. | |
| 6,716,805 | B1 * | 4/2004 | Sherry et al. | 510/295 |
| 6,830,801 | B1 * | 12/2004 | Kenmochi et al. | 428/136 |
| 2001/0029966 | A1 | 10/2001 | Wong et al. | |
| 2002/0050016 | A1 | 5/2002 | Willman et al. | |
| 2004/0000042 | A1 * | 1/2004 | Rivera et al. | 28/106 |

FOREIGN PATENT DOCUMENTS

| | | | |
|---|---|---|---|
| EP | 1764023 | A1 | 3/2007 |
| WO | 2004073480 | A2 | 9/2004 |

* cited by examiner

*Primary Examiner* — David Sample
*Assistant Examiner* — Nicole Gugliotta
(74) *Attorney, Agent, or Firm* — Kilyk & Bowersox, P.L.L.C.; Valerie Calloway

(57) ABSTRACT

The present invention relates to a low oil and basis weight, apertured dusting wipe exhibiting improved particulate pick up performance.

18 Claims, 3 Drawing Sheets

APERTURED DUSTING WIPE

CROSS-REFERENCE TO RELATED APPLICATIONS

This applications claims benefit of priority to U.S. Provisional Application No. 60/717,332, filed Sep. 15, 2005, which is hereby incorporated by reference in its entirety.

TECHNICAL FIELD

The present invention is generally related to a dusting wipe, and more specifically related to a low oil and basis weight, apertured dusting wipe exhibiting an improved particulate pick up performance.

BACKGROUND ART

The general use of nonwoven fabrics as a component in cleaning or dry dusting wipes is well known in the art. Various cleaning and dusting products are commercially available which utilize a combination of topical, performance enhancing additives and/or multi-layered laminate constructions. Multi-layered laminate dusting products are also known in the art. Typically, fibrous carded layers, reinforcing layers, and/or adhesive layers are used in combination in order to form a material with satisfactory loft and function.

Dusting wipes have further utilized raised portions or macroscopic three-dimensional surfaces to improve the functionality of the wipe. Such raised portions are usually incorporated into the surface of a wipe by hydroentanglement and believed to facilitate particulate pick up by entrapping and entraining the particulates. Often, these entangled fabrics include a strengthening layer, such as an open mesh scrim or spunbond layer, which adds to the overall basis weight of the wipe.

It is further known in the art to apply a tacky composition to non-apertured wipes in efforts to order to improve their particulate pick up performance. An adhesive, such as a binder may be applied to the surface of the wiping product. In some instances, a mineral oil has been applied to the non-apertured wiping products in an effort to improve the particulate pick up performance of the wipe. Re-usable high basis weight and non-oiled apertured cloths also have been commercially available for many years, which typically are marketed and used for wiping wet surfaces, such as kitchen and countertop surfaces.

SUMMARY OF THE INVENTION

The present invention is directed to a low oil and basis weight, apertured dusting wipe exhibiting improved particulate pick up performance for dusting applications.

In one embodiment, the dusting wipe comprises a nonwoven fabric having a plurality of apertures, wherein the fabric has a basis weight less than about 60 gsm, at least about 125 apertures per square inch of fabric, and mineral oil in an amount of about 1 to about 15% by weight, wherein the apertured dusting wipe has a pick-up % of at least 8%. In a particular embodiment, the dusting wipe also includes adhesive binder, and especially adhesive binder present as intermittent adhesive spot bonds in the fabric. In another particular embodiment, the dust and dirt pick-up % performance of the inventive dusting wipe is at least 10%, particularly at least 11%, and more particularly at least about 13%. The pick-up % performance may range from 9 to 25%, particularly from 11 to 21%, and more particularly from 13 to 19%. It has been discovered that the low oil content, apertured dusting wipes of the present invention provide synergistically improved levels of particulate detritus pick-up performance at relatively low fabric basis weight, such as compared to low oil non-apertured dusting wipes made of similarly carded fibrous materials that lack apertures as well as apertured fibrous webs lacking adhesive (spot) binder and mineral oil.

In accordance with one embodiment, the nonwoven fabric includes a plurality of slit-like apertures, wherein the dusting wipe may have up to about 250 apertures within a given square inch of fabric. Optionally, the apertures may be of other regular and irregular geometric formations or shapes, such as ovals, circles, rectangles, squares, diamonds, triangles, stars, criss-cross shaped, and the like. The apertures may be arranged in a regular or irregular pattern along (machine direction) and across (cross machine direction) the fabric. As regular patterns, the apertures may be aligned in rows and columns at regular intervals, staggered, clustered, and so forth.

In addition, the apertured dry dusting wipe of the present invention is preferably a single layer, staple fiber substrate. Staple fiber lengths are typically selected in the range of 0.25 inch to 8 inches, wherein a range of 1 to 3 inches is typically preferred and the fiber denier typically selected in the range of 1 to 15, wherein a range of 2 to 6 denier is typically preferred for general applications.

Staple fibers suitable for use with the present invention include natural fibers, synthetic fibers, and combinations thereof. Suitable natural fibers include without limitation, cellulosic fibers such as cotton, wood pulp, hemp, flax, and viscose rayon, singly or in any combinations thereof. Synthetic fibers, which may be blended in whole or part, include thermoplastic and thermoset polymers. Thermoplastic polymers suitable for use include polyolefins, polyamides and polyesters. The thermoplastic polymers may be further selected from homopolymers; copolymers, conjugates and other derivatives including those thermoplastic polymers having incorporated melt additives or surface-active agents.

The apertured dusting wipe of the present invention contains about 1 to about 15, particularly about 5 to about 13, and more particularly about 7 to about 11, weight percent mineral oil. Although not particularly limited, the mineral oil may be white mineral oil, such as chemical grade white mineral oil. Further, the apertured dusting wipe of the present invention has a relatively low basis weight. The basis weight of the dusting wipe is preferably in the range of about 20-60 gsm, more preferably in the range of about 30-60 gsm, and most preferably in the range of about 40-60 gsm.

In another embodiment, the apertured dusting wipe fabric is prepared by hydraulically forming apertures in a carded web of staple fibers to provide an apertured fiber web, which is adhesively spot bonded with a latex binder, followed by application of mineral oil in an effective amount not exceeding about 15 weight percent, such that a low oil apertured dusting fabric is formed having a pick-up % of at least 8%.

In another embodiment, a method is provided removing particulate detritus, such as food crumbs, dust, dirt, or lint and the like, from a surface, such as a hard substantially flat floor (e.g., linoleum, hardwood, marble, flag stone etc.), comprising contacting the surface with the low oil apertured nonwoven fabric effective to transfer the detritus from the surface to fabric.

For purposes herein, the "pick-up %" capability of a fabric is determined by the test method as described in the example section set forth hereinafter.

Figure 1:
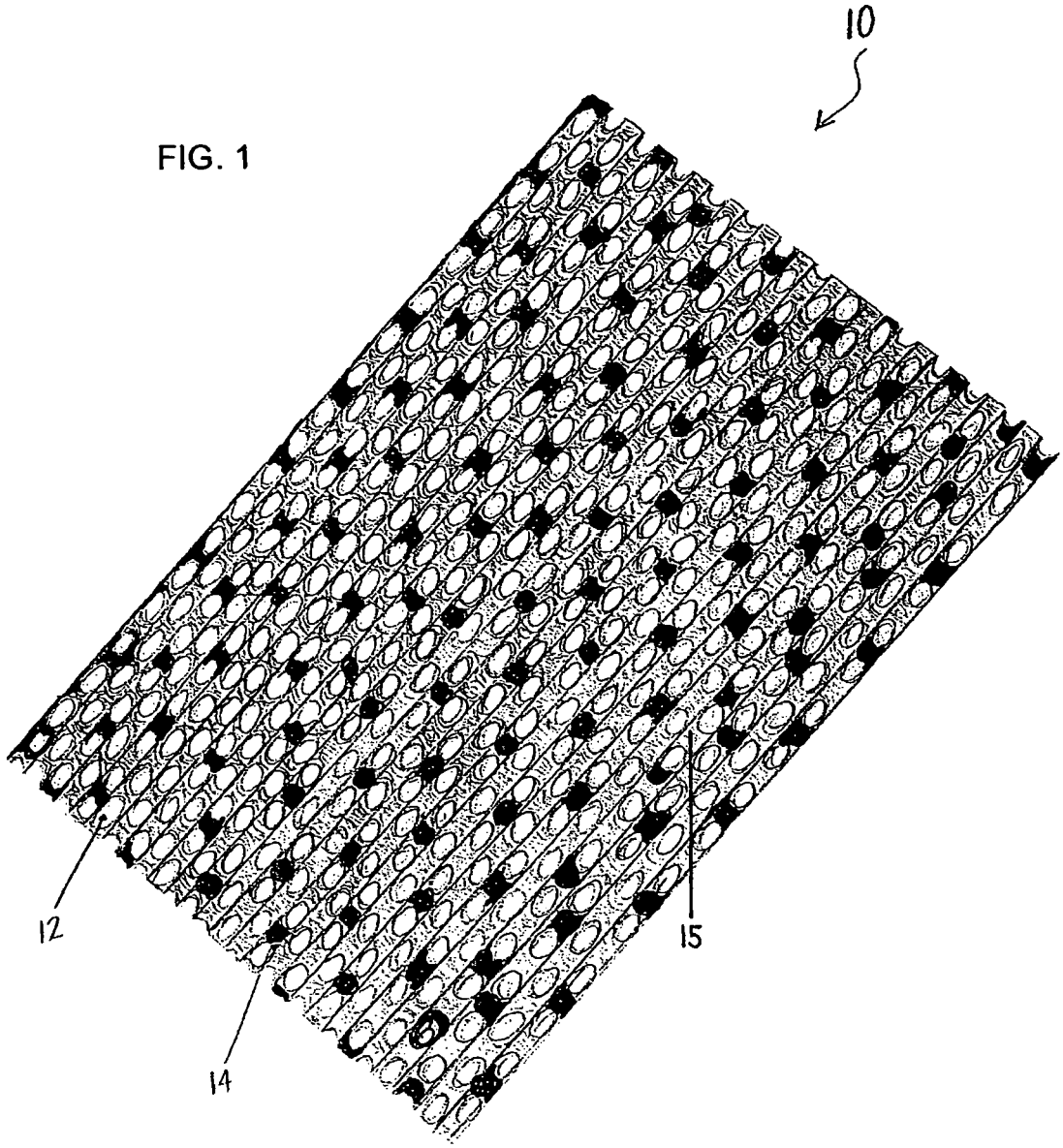
FIG. 1 is a diagrammatic view of an illustrative embodiment of a surface of an apertured nonwoven fabric of the present invention.

The drawings are not necessarily drawn to scale.

DETAILED DESCRIPTION

While the present invention is susceptible of embodiment in various forms, there is shown in the drawings and will hereinafter be described presently preferred embodiments, with the understanding that the present disclosure is to be considered as an exemplification of the invention, and is not intended to limit the invention to the specific embodiments illustrated.

Referring to the drawings, therein FIG. 1 is an illustrative embodiment of the apertured dusting wipe 10 of the present invention, wherein the dusting wipe 10 includes a plurality of apertures 12. Further, the dusting wipe 10 includes an adhesive 14, which is intermittently printed onto one face of the dusting layer in a regular pattern. Land areas 15 of the wipe 10 form a network or lattice-like fabric structure that defines the apertures 12 and provides a substrate or support for the adhesive 14.

Figure 4:
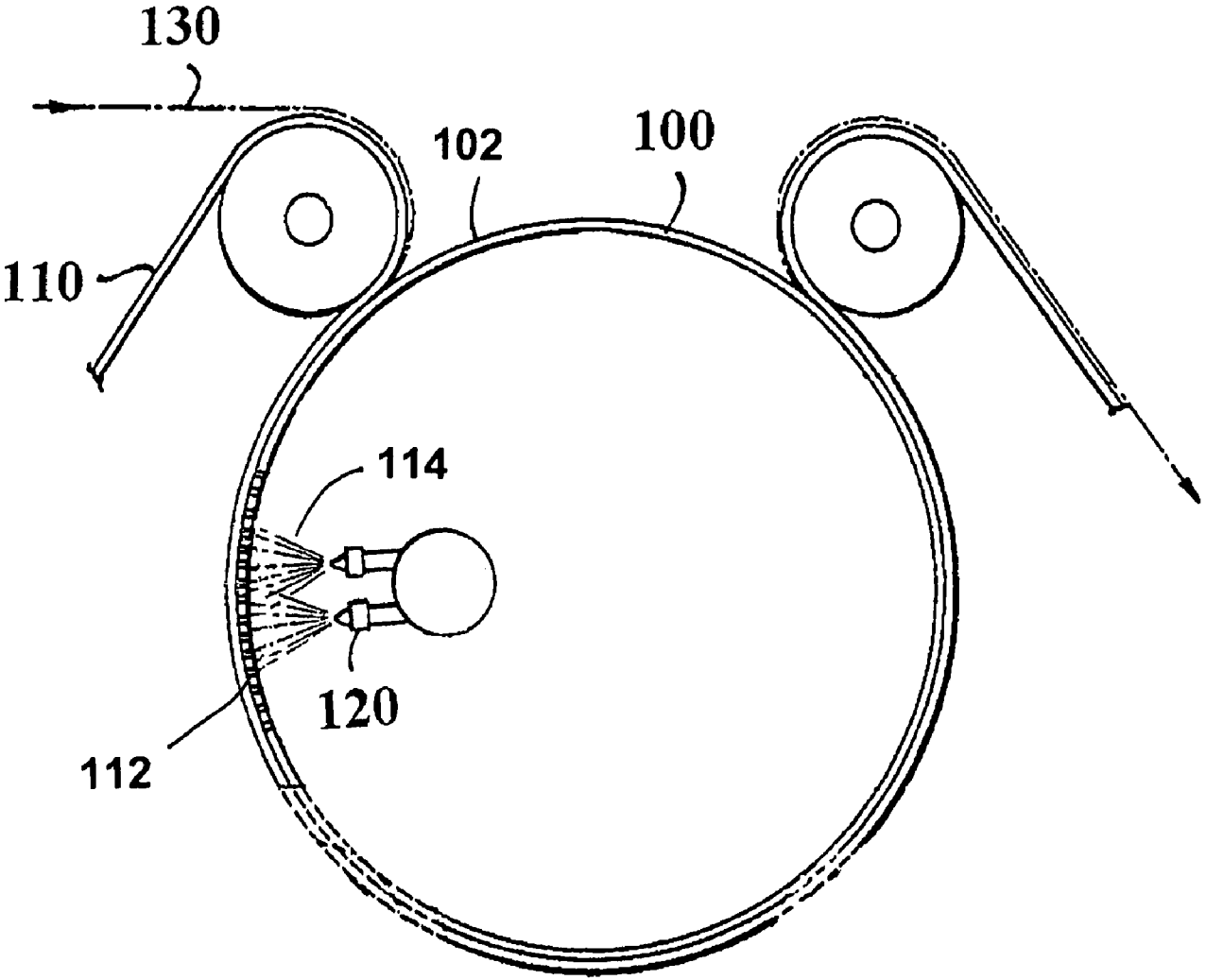
FIG. 4 is a diagrammatic view of an apparatus for practicing a suitable method for hydraulically forming apertures in the nonwoven fabric of the present invention.

In one embodiment and as further illustrated in FIG. 4, an apertured dusting wipe fabric substrate or precursor is formed in accordance with the teachings of U.S. Pat. No. 2,862,251, hereby incorporated by reference. In FIG. 4, there is shown an illustrative embodiment of a drum apparatus suitable for forming the nonwoven fabric for the dusting wipe of the present invention. In this illustration, the apparatus comprises a cylindrical apertured drum 100, a foraminous backing member in the form of a continuous screen belt 110, and spray nozzles 120 inside the drum for projecting streams of liquid 114, preferably water, through the drum apertures 112. To simplify the illustration, the apertures 112 are only shown along a portion of the drum 100 where adjacent the spray nozzles 120. A layer of carded fiber 130 may be sandwiched between the outer cylindrical drum wall 102 and the belt 110 to be rearranged into the apertured dusting wipe fabric substrate of the present invention. Sprayed water from spray nozzles 120 is directed through the drum apertures 112, and then through the carded, staple fiber web 130 effective to form apertures, openings or holes through web 130 that are substantially free of fibers and which are defined between interconnected fiber groupings or land areas. Other features and manners of operation of the apparatus of FIG. 4 may include those such as described in the above-incorporated teachings of U.S. Pat. No. 2,862,251.

Figure 2:
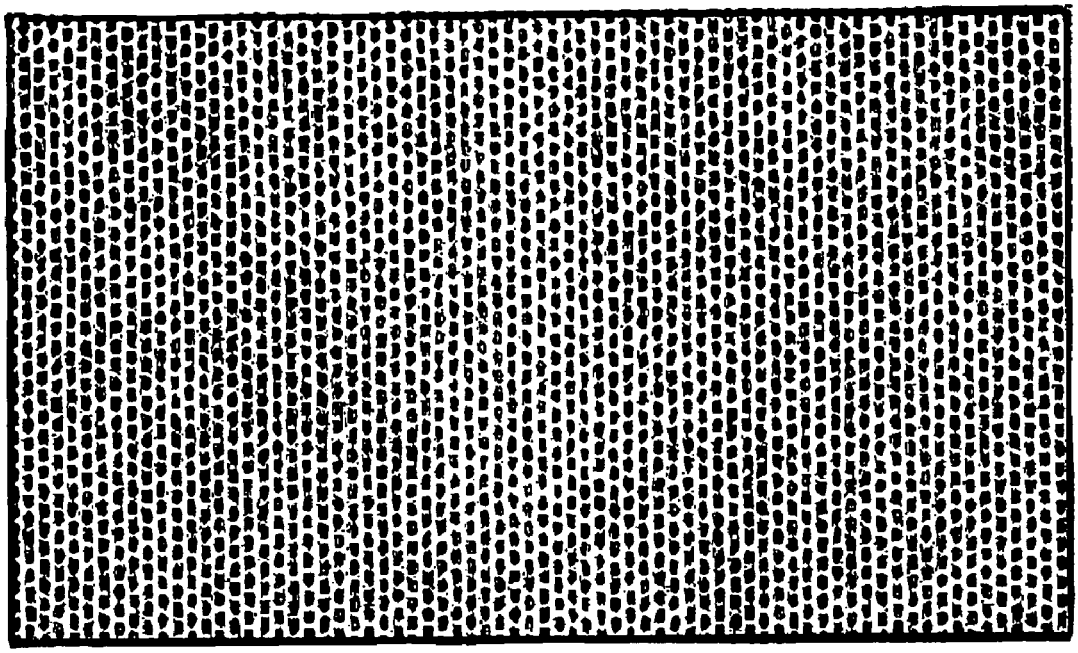
FIG. 2 is a plan view an illustrative embodiment of an apertured nonwoven fabric of the present invention having a staggered formation of apertures.
Figure 3:
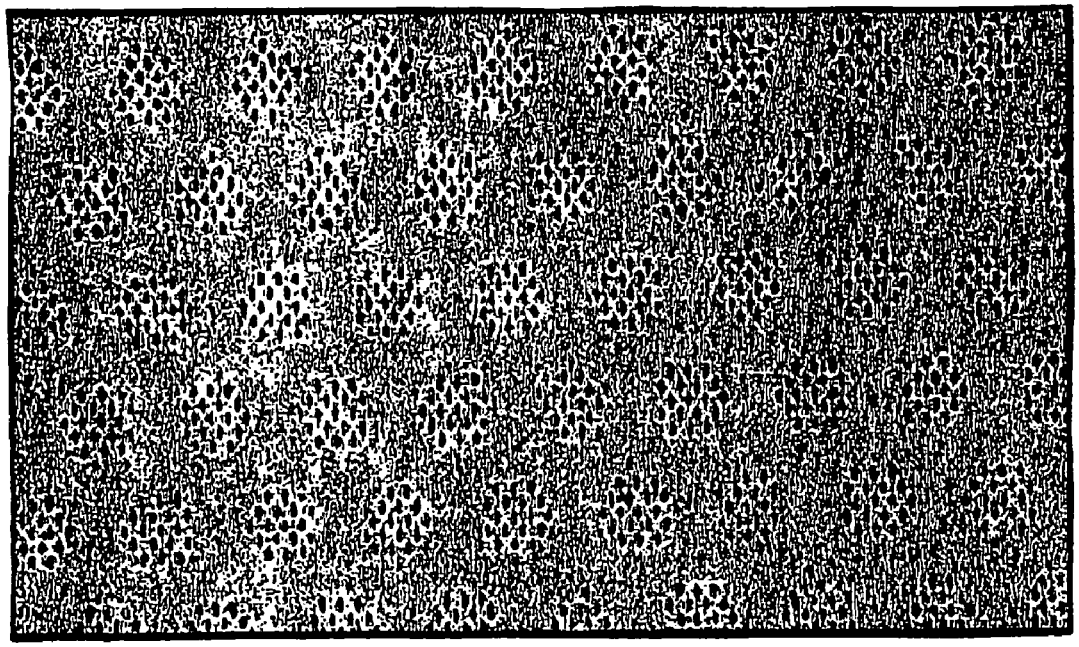
FIG. 3 is a plan view of an illustrative embodiment of an apertured nonwoven fabric of the present invention having clustered formations of apertures.

In one embodiment, the apertures of the dusting wipe may be imparted in a uniformly spaced manner throughout the wipe and may further be of a regular shape. The aperture pattern may comprise aligned rows and columns of apertures, staggered formations (FIG. 2), clusters (FIG. 3), and so forth. Alternately, the apertures may be imparted into the wipe in a non-uniformly spaced manner and may further be of irregular shapes. Particularly, the apertures may be slit-like or oval; however it is also contemplated that the apertures may be oval, circular, square, rectangular, triangle, diamond, star shaped, criss-crossed in shape, or the like. In addition, the substantially dry dusting wipe of the present invention may include about 125-250 apertures per square inch of fabric (i.e., 19-39 apertures/$cm^2$), more preferably about 150-225 apertures per square inch of fabric (i.e., 23-35 apertures/$cm^2$), and most preferably includes about 165-200 apertures per square inch of fabric (i.e., 26-31 apertures/$cm^2$). For the overall fabric, the ratio of total fabric land area to opening area (e.g., $cm^2$ total land area/$cm^2$ total hole area) may range from about 1 to about 9, particularly about 2.5 to about 7.5, more particularly about 4 to about 6. Generally, if the proportion of hole area becomes too small relative to land area in the fabric, the pick up performance may drop off to unsatisfactory levels, while, conversely, if it becomes too large the fabric may lack sufficient structural integrity for cleaning/wiping applications. The proportions of hole and land areas in the wipes can be determined by known optometric techniques generally used for making such determinations on apertured planar materials.

Subsequent to forming the apertured web substrate or precursor, the dusting wipe precursor is subjected to an adhesive bond step. In one embodiment, an adhesive is applied, e.g., printed, onto the wipe so as to bond discrete portions of the staple length fibers while retaining other portions of the staple length fibers in an unbonded state. The adhesive bonding step of the present invention may include printing the adhesive onto the dusting wipe in regular or irregular pattern. In one embodiment and as shown FIG. 1, the adhesive 14 is applied uniformly in a discontinuous pattern. The adhesive pattern may include any discontinuous pattern and is not intended to be a limiting factor of the present invention. The adhesive may be kiss-coated or padded onto the wipe. In one particular embodiment, the apertured dusting wipe fabric is prepared by hydraulically forming apertures in a carded web of staple fibers to provide an apertured fiber web, which is adhesively spot-bonded with a latex binder. The latex binder may be topically applied to at least one surface of the apertured fabric effective to provide a total add-on amount to the fabric, on a solids basis, ranging from about 1 to about 25 g/$m^2$, and particularly ranging from about 3 to about 15 g/$m^2$, based on total weight of finished wipe. Although not desiring to be bound to any particular theory, the application of adhesive binder is thought to cause disruption of fibers at the surface of the apertured fibrous web proximate the sites where adhesive binder is deposited upon the fabric surface, which in scale is akin to a small degree of fraying, which phenomenon provides a more even distribution of subsequently applied mineral oil, which in turn, enhances dust and dirt pick up capabilities of the finished fabric. Nonetheless, in embodiments the inventive fabric product is a substantially flat surfaced on both major surfaces thereof. It does not have three-dimensional out-of-plane structures embossed, hydroentangled, or otherwise formed therein, and does not need such structures to possess its improved dust pick-up % capabilities. Alternately, the adhesive may be applied in a continuous pattern, wherein the pattern may be linear in formation or wave-like. The adhesive binder content of the fibrous web is dried or allowed to dry before subsequent application of mineral oil to the fibrous web.

Mineral oil is topically applied to the fibrous web after the web carding, hydraulic aperturing, and adhesive binding procedures. In a particular embodiment, the mineral oil is generally evenly applied to a surface of the apertured web by padding, in amounts effective to penetrate, migrate and/or wick through the entire thickness of land areas of apertured web.

The mineral oil may be present in the dusting wipe in a range from about 1-15% by weight, more preferably in a range of about 5-13% by weight, and most preferably in a range of about 7-11% by weight. The type of mineral oil is not particularly limited as long it is compatible with household applications or other intended environment use of the dusting wipe. A particular type of mineral oil that may be used is chemical grade white mineral oil. Preferably, the mineral oil is topically applied by a printing method; however other application methods known in the art may be utilized for imparting a mineral oil to the fabric.

In one embodiment, the low oil, apertured dusting wipe of the present invention is a single layer, staple fiber substrate construction. Staple fiber lengths are typically selected in the range of 0.25 inch to 8 inches (0.6 to 20 cm), wherein a range of 1 to 3 inches (2.5 to 7.6 cm) is typically preferred and the fiber denier typically selected in the range of 1 to 15, wherein a range of 1.5 to 6 denier is typically preferred for general applications.

Staple fibers suitable for use with the present invention include natural fibers, synthetic fibers, and combinations thereof. Suitable natural fibers include without limitation, cellulosic fibers such as cotton, wood pulp, hemp, flax, and viscose rayon, singly or in combinations thereof. Synthetic fibers, which may be blended in whole or part, include thermoplastic and thermoset polymers. Thermoplastic polymers suitable for use include polyolefins, polyamides and polyesters. The thermoplastic polymers may be further selected from homopolymers, copolymers, conjugates, sheath-cores, and other derivatives including those thermoplastic polymers having incorporated melt additives and/or surface-active agents, and/or other fiber additives. In one embodiment, the apertured dusting wipe of the present invention may utilize 100% viscose rayon or other cellulosic staple fiber.

The pick-up % performance of the inventive dusting wipe is at least 8%, particularly at least 10%, more particularly at least about 11%, and even more particularly at least about 13%. The pick up % performance of the inventive fabric may range from 9 to 25%, particularly from 11 to 21%, and more particularly from 13 to 19%. Further, the dusting wipe exhibits a relatively low basis weight. The types of particulate detritus which the inventive fabrics are capable of removing from a surfaces and capturing are not necessarily limited and include, e.g., small food crumbs, dust, soil, lint, and so forth. The basis weight of the dusting wipe is generally in the range of about 20-60 gsm (g/m$^2$), particularly in the range of about 30-60 gsm, and more particularly in the range of about 40-60 gsm. The inventive fabrics provide enhanced dust and dirt pick-up performance even at these relatively low basis weight values.

In accordance with the present invention, the dusting wipe is substantially dry, wherein a relatively small percentage of mineral oil is utilized to enhance the overall cleaning performance of the wipe. "Substantially dry" herein means the dusting wipe is not wet or moist to the touch.

The apertured nonwoven fabrics of the present invention may be used as disposable dusting and cleaning hand wipes, or as disposable dusting and cleaning wipes that can be removably mounted on mop heads and the like. Although not limited thereto, the apertured nonwoven fabrics of the invention are particularly suitable as household dusting and cleaning wipes. For example, the wipes can cut into discrete rectangular shapes which are sized such that the majority of the dusting wipe is draped across the working side of the mop head while edges thereof are manually wrappable around the mop head for removable attachment in gripping means provided on the backside of the mop.

The examples that follow are intended to further illustrate, and not limit, embodiments in accordance with the invention. All percentages, ratios, parts, and amounts used and described herein are by weight unless indicated otherwise.

EXAMPLES

The ability of low mineral oil content, apertured nonwoven fabrics in accordance with an embodiment of the present invention and several comparison dusting fabrics to attract and hold particles was evaluated.

Low mineral oil content, apertured nonwoven fabric representative of an embodiment of the present invention was made in the following manner. An apertured substrate web was formed by carding 100% viscose rayon staple fibers (length: 1 9/16 inches (approximately 40 mm), 1.5 denier) into a web and forming a pattern of apertures therein corresponding generally to that shown in FIG. 2 using the general procedures and equipment lay-out of FIG. 4 such as described in U.S. Pat. No. 2,862,251. Latex adhesive binder was applied to the apertured fabric substrate or precursor For purposes of these studies, the tested fabrics were designated as follows. 1: inventive dusting fabric (small apertures, i.e. approximately 3/64 inch (1.2 mm) in diameter); 2: inventive dusting fabric (small apertures); 3: inventive dusting fabric (large apertures, i.e. approximately 1/8 inch (3.2 mm) in diameter); 4: inventive dusting fabric (small apertures); C1: Stretch N Dust™ (commercial non-apertured wipe cloth); C2: massalin standard oil cloth (no apertures); C3: massalin standard oil cloth (no apertures).

Pick-Up % Test Method: The pick-up % test method includes combining a mixture of particulate matter, specifically a mixture of approximately 50-70% cereal crumbs, 15-25% top soil, and 15-25% dust particles collected from vacuum cleaner bags. These particulates range in size from about 0.2 to about 2.0 mm. The mixture was weighed out into a total weight of 1.0 grams +/−0.005 grams per test run. The mixture of particulate matter was evenly scattered on a clean, dry 32 inch×48 inch (81 cm×122 cm) vinyl flooring surface from a distance of one foot above the flooring surface using a handheld flour sifter. The dusting wipe fabric was weighed prior to use. The dusting wipe fabric sample was mounted onto a commercial dry swivel mop head having a plurality of conventional slitted polymeric fabric grippers on the backside thereof and an approximately 4 inch×10 inch (10 cm×25 cm) rectangular shaped mounting head, with the face side or fuzzy side of the fabric arranged to face the floor. The test samples were sized to accommodate the mop head and integral mounting means thereof. The mop was held at approximately a 45-degree angle and pushed forward, parallel to the right floor edge of the flooring around the outer portions of the flooring along a pathway comprising a square-shaped outer loop and then the mop head was pushed through a square-shaped inner loop to traverse inner portions of the flooring surface area that were not traversed in the outer loop. The mop was allowed to guide over the floor surface without adding additional pressure to the mop. Further, the mop remained on the flooring surface until the test was complete. The amount of the particulate matter collected was reported by re-weighing the wipe sample after dusting and determining the difference in weight from the initial fabric weight.

"Softness" of the test fabrics was determined by Handle-O-Meter. Machine direction tensile strength "MDT" was determined by Instron tensile tester. Cross direction tensile strength "CDT" was determined by Instron tensile tester. Cross direction elongation "CD elongation" was determined by Instron tensile tester. "Osy" refers to ounces per square yard.

The following tables show physical test results, including a comparative study, wherein the dusting wipe bulk and pick-up percentage is disclosed for each test sample of dusting fabric.

TABLE 1

| Sample | oil content (wt %) | weight (osy) | pick-up % | Softness | MDT (lbs./in.) | CDT (lbs./in) | CD elong. (%) |
|---|---|---|---|---|---|---|---|
| 1 | 9.2 | 1.14 (39 gsm) | 15.3 | 41.1 | 22.1 | 2.5 | 99.2 |
| 2 | 11.2 | 1.57 (53 gsm) | 11.55 | 53 | 23.8 | 2.4 | 110.3 |
| 3 | 11.9 | 1.25 (42 gsm) | 8.15 | 51.5 | 32.6 | 3.8 | 99.8 |
| 4 | 7.4 | 1.06 (36 gsm) | 10.3 | 46.9 | 23.3 | 2.4 | 100.5 |
| C1 | 8 | 1.51 (51 gsm) | 9.57 | 61.9 | 29 | 2.4 | 99.3 |
| C2 | 8.9 | 1.79 (61 gsm) | 8 | 66 | 31.8 | 2.7 | — |
| C3 | 8.2 | 1.29 (44 gsm) | 7.1 | 51 | 27.1 | 2.1 | — |

The data shows those apertured nonwoven fabrics of the present invention with low oil and basis weights and smaller apertures have an improved particulate pick up performance, even while utilizing less mineral oil. The following tables show physical test results, including a comparative study, wherein the dusting wipe bulk and pick-up percentage is disclosed.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

The invention claimed is:

1. An apertured dusting wipe, comprising an apertured nonwoven fabric having a plurality of apertures wherein the apertures are holes through a nonwoven fibrous web defining wipe hole areas, wherein the holes are free of fibers and which are defined between interconnected fiber groupings or land areas of the nonwoven fabric, wherein the nonwoven fabric has a basis weight less than about 60 gsm, and mineral oil in an amount of about 1 to about 15% by weight, and wherein the nonwoven fabric is an adhesive bonded fabric comprising adhesive applied to the nonwoven fabric wherein the adhesive comprises a latex binder topically applied to at least one surface of the nonwoven fabric in a total add-on amount, on a solids basis, ranging from about 1 to about 25 g/m$^2$, with disruption of fibers at the surface of the apertured nonwoven fabric proximate sites where the adhesive binder is deposited upon the fabric surface, and said wipe having a ratio of total fabric land area to total hole area of from about 1 to about 9, and wherein said apertured dusting wipe is a single layer nonwoven fabric construction having a pick-up % of at least 8%.

2. An apertured dusting wipe as in claim 1, wherein the nonwoven fabric is comprised of staple length fibers.

3. An apertured dusting wipe as in claim 1, wherein the latex binder is topically applied to at least one surface of the nonwoven fabric in a total add-on amount, on a solids basis, ranging from about 3 to about 15 g/m$^2$.

4. An apertured dusting wipe as in claim 3, wherein the adhesive is applied in a continuous pattern.

5. An apertured dusting wipe as in claim 2, wherein the staple length fibers are selected from the group consisting of natural fibers, synthetic fibers, and combinations thereof.

6. An apertured dusting wipe as in claim 5, wherein the staple length fibers are fibers selected from the group consisting of cellulosic, polyolefins, polyesters, polyamides, and combinations thereof.

7. An apertured dusting wipe as in claim 2, wherein the staple length fibers comprise viscose rayon staple fibers.

8. An apertured dusting wipe as in claim 1, wherein the apertures have a shape selected from oval, circular, square, rectangular, triangle, diamond, star shape, and criss-crossed.

9. An apertured dusting wipe as in claim 1, wherein the wipe contains about 7% to about 13% by weight mineral oil.

10. An apertured dusting wipe as in claim 1, wherein said nonwoven fabric comprising a cellulosic nonwoven fabric and an adhesive topically applied in a discontinuous pattern, wherein said apertured dusting wipe has a pick-up % of at least 10%.

11. An apertured dusting wipe, comprising an apertured nonwoven fabric having a plurality of apertures wherein the apertures are holes through a nonwoven fibrous web defining wipe hole areas, wherein the holes are free of fibers and which are defined between interconnected fiber groupings or land areas of the nonwoven fabric, wherein the nonwoven fabric has a basis weight less than about 60 gsm, and mineral oil in an amount of about 1 to about 15% by weight, and wherein the nonwoven fabric is an adhesive bonded fabric comprising adhesive applied to the nonwoven fabric wherein the adhesive comprises a latex binder topically applied to at least one surface of the nonwoven fabric in a total add-on amount, on a solids basis, ranging from about 3 to about 15 g/m$^2$, with disruption of fibers at the surface of the nonwoven fabric proximate sites where the adhesive binder is deposited upon the fabric surface, and said dusting wipe having a ratio of total fabric land area to total hole area of from about 1 to about 9, wherein said apertured dusting wipe is a single layer nonwoven fabric construction having a pick-up % of at least 10%.

12. An apertured dusting wipe as in claim 11, wherein the ratio of total fabric land area to total hole area is from about 2.5 to about 7.5.

13. An apertured dusting wipe, comprising an apertured nonwoven fabric having a plurality of apertures wherein the apertures are holes through a nonwoven fibrous web defining wipe hole areas, wherein the holes are free of fibers and which are defined between interconnected fiber groupings or land areas of the nonwoven fabric, wherein the nonwoven fabric has a basis weight less than about 60 gsm, and mineral oil in an amount of about 1 to about 15% by weight, wherein the nonwoven fabric is an adhesive bonded fabric comprising adhesive applied to the nonwoven fabric wherein the adhesive comprises a latex binder topically applied to at least one surface of the nonwoven fabric in a total add-on amount, on a solids basis, ranging from about 3 to about 15 g/m$^2$, with disruption of fibers at the surface of the apertured nonwoven fabric proximate sites where the adhesive binder is deposited upon the fabric surface, and said dusting wipe is a single layer nonwoven fabric construction having a ratio of total fabric land area to total hole area of from 1 to 9.

14. An apertured dusting wipe as in claim 13, comprising about 125 to 250 apertures per square inch of fabric.

15. An apertured dusting wipe as in claim 1, wherein said apertured dusting wipe is a single layer, staple fiber substrate.

16. An apertured dusting wipe as in claim 13, wherein said apertured dusting wipe is a single layer, staple fiber substrate.

17. An apertured dusting wipe as in claim 1, wherein the nonwoven fabric comprises viscose rayon staple fibers, and the latex binder is topically applied to at least one surface of the nonwoven fabric in a total add-on amount, on a solids basis, ranging from about 3 to about 15 $g/m^2$.

18. An apertured dusting wipe as in claim 1, wherein said apertured dusting wipe has a pick-up % of from 9% to 25%.

* * * * *